United States Patent [19]

Boden et al.

[11] Patent Number: 4,464,110

[45] Date of Patent: Aug. 7, 1984

[54] FLARE USING A COANDA DIRECTOR SURFACE

[75] Inventors: John C. Boden, Epsom; Gerald Pratley, Hampton, both of England

[73] Assignee: The British Petroleum Company Limited, London, England

[21] Appl. No.: 326,286

[22] Filed: Dec. 1, 1981

[30] Foreign Application Priority Data

Dec. 10, 1980 [GB] United Kingdom ..... 8039514

[51] Int. Cl.[3] ..... F23D 15/04

[52] U.S. Cl. ..... 431/350; 431/202; 431/284; 239/DIG. 7

[58] Field of Search ..... 431/202, 4; 239/DIG. 7, 239/424; 431/284, 350

[56] References Cited

U.S. PATENT DOCUMENTS 3,709,654 1/1973 Desty et al. ..... 431/284
3,840,320 1/1974 Desty et al. ..... 431/4

FOREIGN PATENT DOCUMENTS 1421765 1/1976 United Kingdom .
2021250 11/1979 United Kingdom ..... 431/202

*Primary Examiner*—Samuel Scott
*Assistant Examiner*—Allen J. Flanigan
*Attorney, Agent, or Firm*—Morgan, Finnegan, Pine, Foley & Lee

[57] ABSTRACT

A high pressure gas flare using the Coanda effect and having an internal passageway for low pressure fuel gas has a high pressure gas flow modifier on the outer surface of the Coanda body. The flow modifier may be in the form of one or more projections downstream from the high pressure gas outlet, the projections tending to stabilize the flame.

8 Claims, 7 Drawing Figures

FLARE USING A COANDA DIRECTOR SURFACE

Figure 1A:
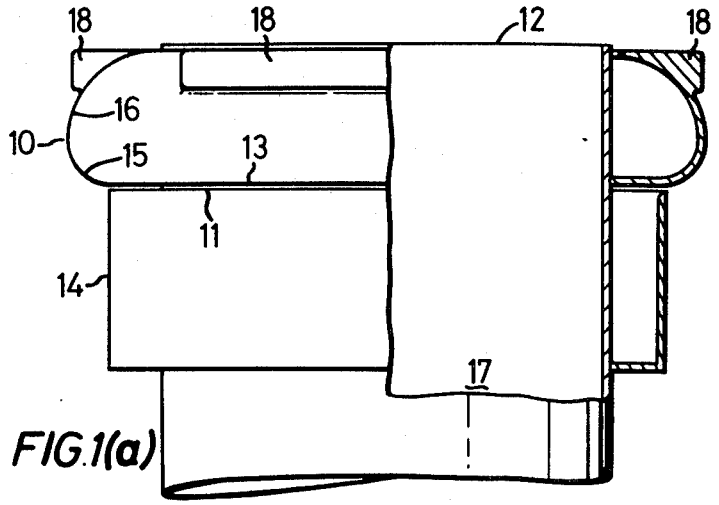

The present invention relates to flares and more particularly relates to Coanda flares.

Refinery and chemical plant operation often require that a vessel is vented through pressure relief valves into a vent system running at near atmospheric pressure. Gas from this low pressure vent system is then disposed of by flaring from an elevated stack.

Since the low pressure of the gas precludes the use of air entrainment devices, and the possible sulphur content makes ground level flaring in a natural draught flare impractible, often the only way to improve combustion and reduce the amount of smoke formed during such emergency flaring operations is to add steam.

Our U.K. Pat. No. 1381867 discloses the use of a Coanda flare using steam. Usually with steam driven flares it is found that under certain conditions, involving an abnormally high ratio of steam flow to gas flow, the flame tends to lift off the stack, and the present invention is directed towards alleviating this tendency.

Thus according to the present invention there is provided a flare comprising a supply line for a pressurised gas and a Coanda body positioned over the outlet of the supply line so as to define a high pressure gas outlet adapted to direct the issuing high pressure gas over the outer surface of the Coanda body, the Coanda body having an internal passageway for a low pressure gas, the issuing high pressure gas entraining surrounding air and being directed toward the outlet of the internal passageway, the Coanda body having high pressure gas flow modifying means, preferably in the form of one or more projections on its surface downstream from the high pressure gas outlet.

Although the flare is primarily designed for the flow modifying means could be used for stabilising a Coanda flare where the high pressure gas is fuel gas and the low pressure gas is fuel gas.

It is believed that the flow modifying means tends to stabilise the flame of the flare in either or both of the following ways. Firstly, by increasing the diameter of the steam/air/fuel gas flow region above the tip of the flare, the flow modifying means reduces the upward steam/air velocity at the flame front thereby reducing the flame lift off tendency. Secondly, the eddies formed at the ends of the flow modifying means mix fuel gas locally into the steam/air flow thereby creating a stabilising flame.

It is known that when the extension of one lip of the mouth of a slot through which a fluid emerges under pressure, progressively diverges from the axis of the slot, the stream of fluid emerging through the slot tends to stick to the extended lip thus creating a pressure drop in the surrounding fluid thus causing fluid flow towards the low pressure region. This physical phenomenon is known as the Coanda effect and a body exhibiting this effect is known as a Coanda body. The Coanda body usually is of (a) the internal venturi-shaped type in which the pressurised fluid emerges from an orifice near the throat of the venturi passes towards the mouth or (b) the external type in which the pressurised fluid emerges from an orifice and passes outwards over an external director surface of a Coanda body. The present invention uses a Coanda body of type (b).

The projections are preferably located on the downstream portion of the Coanda body and may take the form of a single circumferential projection. The projections may be positioned on or integral with the Coanda body.

In the case of more than one projection being used, the projections are preferably located symmetrically on the Coanda body and a preferred embodiment is in the form of symmetrical pairs.

The projections are preferably wedge-shaped with the hypotenuse modified to conform with the Coanda Body.

The materials of consruction for the projection are preferably the same as for the Coanda body and are most preferably austenitic stainless steel or a nickel alloy.

Preferably the gas is steam and emerges from the feed line at a pressure in the range of 5 to 100 p.s.i. of steam.

In order to further stabilise the flame, other forms of baffle may be used in addition to the projections, the baffles most preferably being near or within the outlet of the internal passageway. A suitable type of baffle is described in UK Pat. application No. 2028489A.

The invention will now be described by way of example with reference to FIGS. 1 to 4 of the accompanying drawings.

The burner shown comprises a director surface 10 which forms the outer surface of a director body which has a steam outlet 11 for steam at its lower end and a secondary outlet 12 for fuel gas at its upper end. During use the steam flows over the director surface 10 and this flow initiates flow of steam and air towards the secondary fuel gas outlet 12.

The director body has a flat base 12 and the steam outlet 11 takes the form of an annular slot formed between the wall of the steam line 14 and the flat base 13 so that the steam leaves the steam outlet 11 as a thin horizontal sheet.

The director surface 10 comprises two portions, namely a deflector portion 15 which turns the direction of flow of the steam from the horizontal to vertical, and a continuation portion 16 which maintains the flow of steam and air between the deflector portion 15 and the fuel gas outlet 12. The purpose of this curved continuation 16 is to allow a suitable separation between the steam outlet 11 and the secondary outlet 12, while maintaining the skin effect up to the secondary outlet 12.

The shape of the deflector portion 15 is most conveniently specified as the surface of revolution formed by the rotation of a quadrant of a circle about the longitudinal axis of the director body, the curved section of the quadrant being tangential to the steam outlet; as shown in the drawing the distance between the axis of rotation and the centre of the quadrant is several times the radius of the quadrant. The continuation portion 16 is again a surface of revolution, but of an arc of larger radius than that of the quadrant, thus giving rise to a tapered portion.

As the steam flows around the deflector portion 15 its direction of flow is changed from (initially) horizontal to vertical. This induces movement of air as well as steam towards the secondary outlet 12.

The fuel is conveyed to the secondary outlet by the fuel gas line 17 (which forms an annular configuration with the stem line 14) and fuel which issues from the fuel line 17 meets the converging stream of steam and air moving over surface 16.

A number of high pressure gas flow modifying means in the form of projections are positioned on or are integral with the Coanda surface. Each projection comprises a baffle 18 fixed above the continuation portion 16 of the Coanda surface and extending outwards approximately to the maximum diameter of the Coanda surface.

Figure 1B:
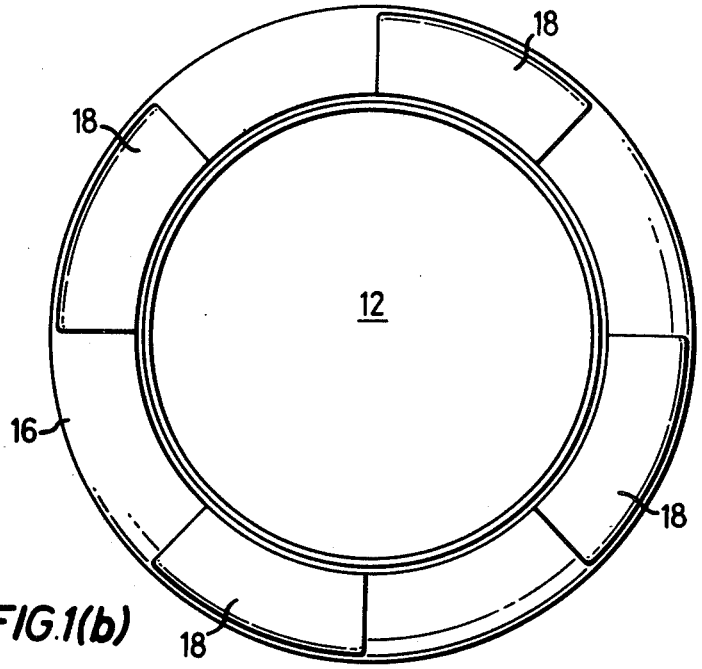
Figure 2:
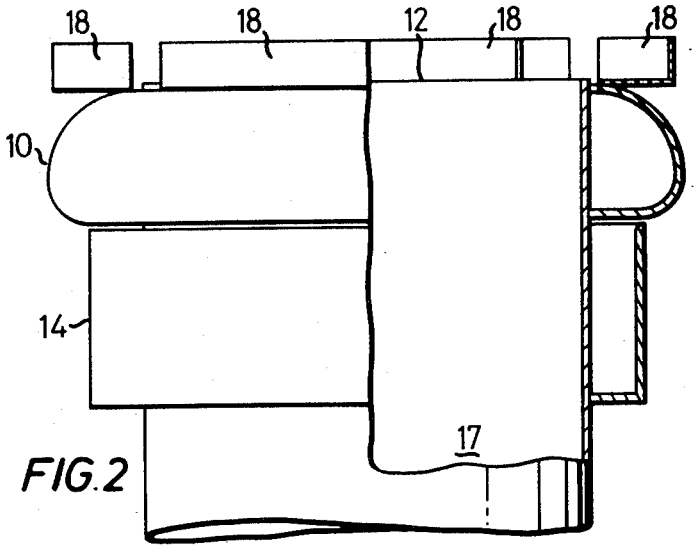
Figure 3A:
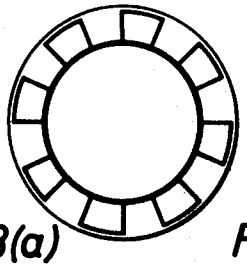
Figure 3B:
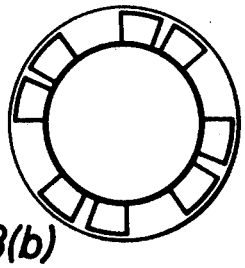
Figure 4A:
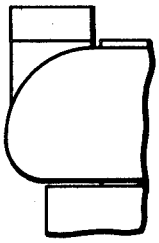
Figure 4B:
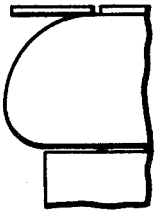

FIGS. 1(*a*) and 1(*b*) shows an arrangement of a flare having one form of projection according to the invention located on the Coanda surface. FIG. 1(*a*) is an elevation, partly cut away through the flare and FIG. 1(*b*) is a view showing an arrangement of projections around the contiuation portion of the Coanda surface. The projections are set back from the maximum diameter of the Coanda surface by about 15% of the smaller radius of curvature of the deflector portion 15 of the Coanda surface. FIG. 2 shows an elevation, partly cut away, through the flare and having an alternative form of projection. FIG. 3(*a*) uses eight projections equally spaced around the Coanda surface and FIG. 3(*b*) uses eight projections in equally separated pairs. FIGS. 4(*a*) and 4(*b*) illustrate two further forms of projections.

In a typical series of trials, projections of the form shown in FIGS. 1 and 2 raised the steam flow at which the flame was extinguished by a factor of 2 to 3 without adversely affecting the performance of the flare. The projections of FIGS. 3 and 4 show a similar effect.

We claim:

1. A flare comprising a supply line for a pressurized gas and a Coanda body positioned over the outlet of the supply line so as to define a high pressure gas outlet adapted to direct the issuing high pressure gas over the outer surface of the Coanda body, means forming a low pressure gas passageway extending through the Coanda body and having an outlet at the upper end of the Coanda body, the issuing high pressure gas entraining surrounding air and being directed towards the outlet of the low pressure gas passageway, the Coanda body having a high pressure gas flow modifying means including discontinuous spaced projections on its outer surface and downstream from the high pressure gas outlet.

2. A flare according claim 1 in which the flow modifying means comprises a plurality of projections located symmetrically on the Coanda body.

3. A flare according to claim 2 in which the projections are wedge-shaped with the hypotenum modified to conform with the Coanda body.

4. A flare according to claim 2 in which the projections are arranged in symmetrical pairs.

5. A flare according to claim 1 in which the flow modifying means is fabricated from austenitic stainless steel or a nickel alloy.

6. A flare according to claim 1 which has a flame stabilising baffle.

7. A flare comprising a supply line for a pressurized gas and a Coanda body positioned over the outlet of the supply line so as to define a high pressure gas outlet adapted to direct the issuing high pressure gas over the outer surface of the Coanda body, means forming a low pressure gas passageway extending through the Coanda body and having an outlet at the upper end of the Coanda body, the issuing high pressure gas entraining surrounding air and being directed towards the outlet of the low pressure gas passageway, the Coanda body having a high pressure gas flow modifying means comprising one or more projections on its outer surface and downstream from high pressure gas outlet, each projection comprising a plurality of separated horizontal flat plates.

8. A flare according to claim 7 in which the flat plates have an upright lip or extension at the edge of the ring or plate.

* * * * *